US006655060B2

(12) United States Patent
Grate et al.

(10) Patent No.: US 6,655,060 B2
(45) Date of Patent: Dec. 2, 2003

(54) CHANNEL LETTER

(76) Inventors: Anton Grate, 38 Coventry Chase, Joliet, IL (US) 60431; Cheryl Grate, 708 Cambridge La., Shorewood, IL (US) 60435

( * ) Notice: Subject to any disclaimer, the term of this patent is extended or adjusted under 35 U.S.C. 154(b) by 70 days.

(21) Appl. No.: 09/812,652

(22) Filed: Mar. 20, 2001

(65) Prior Publication Data

US 2001/0042330 A1 Nov. 22, 2001

Related U.S. Application Data

(63) Continuation-in-part of application No. 09/241,644, filed on Feb. 1, 1999, now Pat. No. 6,202,333.

(51) Int. Cl.[7] ..... G09F 13/00
(52) U.S. Cl. ..... 40/575; 40/552
(58) Field of Search ..... 40/552, 564, 575, 40/716

(56) References Cited

U.S. PATENT DOCUMENTS 1,697,501 A 1/1929 Gast
2,902,787 A 9/1959 Cook
4,097,632 A * 6/1978 Minogue et al. ..... 40/578
4,796,170 A 1/1989 Pedersen

FOREIGN PATENT DOCUMENTS

FR 1091509 1/1954

* cited by examiner

*Primary Examiner*—Cassandra H. Davis
(74) *Attorney, Agent, or Firm*—Robert L. Marsh

(57) ABSTRACT

A channel letter has a rear surface for mounting against a raceway, wall, or a structure for supporting the signage, and sides defining the figuration of the letter of shape to be depicted. A lighting element is positioned against the rear surface of the enclosure, and a lens is retained to the open front of the enclosure. The lens may be retained by a plurality of retainers to a shoulder recessed within the walls of the enclosure. As a first alternative, the retainers may retain a lens without a shoulder where a sealing edging is fitted around the perimeter of the lens. As a second alternative a lens having dimensions greater than those of the enclosure may be retained across the forward end thereof.

4 Claims, 4 Drawing Sheets

CHANNEL LETTER

This is a Continuation-In-Part of our application filed Feb. 1, 1999 and assigned Ser. No. 09/241,644 now U.S. Pat. No. 6,202,333. The present invention relates to channel letters of the type used to create signage and, in particular, to an improved method of manufacturing a channel letter.

BACKGROUND OF THE INVENTION

Channel letters are used to provide signage for buildings, shopping malls, and the like where it is desirable that the signage comprise illuminated letters or any other shapes that are easily seen, even at great distances, day or night. Each channel letter consists of an enclosure, usually a metal box, having a rear surface which is positioned against a raceway, or the wall of a building, on which the signage is mounted and a plurality of sides which define the figuration of a letter or number which make up a portion of the sign. A light source, such as a neon tube, is positioned within the walls of the enclosure and attached to the rear surface to provide illumination for the letter.

The light sources used in existing channel letters are neon bulbs requiring high voltage power with transformers built into the metal enclosures. To prevent injury to those servicing such channels letters many municipalities require that such letters be inspected to ensure that they are adequately sealed using standards set by Underwriters Laboratories.

It is expected that new technology will soon be available for the manufacturers of channel letters. Specifically, low voltage LED type light sources have been developed which provide a very long lasting bright light without requiring the high voltage and transformers needed for neon lighting. It is expected that channel letters employing the new technology will not be required to meet the standards set by Underwriters Laboratories.

In addition to the lighting, a channel letter also includes a planar, transparent lens, the outer shape of which corresponds to the figuration of the letter or any other shape defined by the sides of the enclosure. The lens of existing channel letters have a trim cap glued to the outer edges thereof which form a border to the lens. The trim cap also has a lip which, when assembled to the enclosure, is shaped to fit snugly around the forward ends of the walls thereof for retaining the lens to the enclosure and to maintain the water tight seal required by Underwriters Laboratories. Screws are threaded through the lips of the trim cap and into the walls to retain the lens across the forward opening of the enclosure.

The manufacture of the lens requires that a planar panel of transparent plastic be cut to the shape of the enclosure and that the trim cap be glued to the outer edges of the lens. The contours of the sides of many letters are curved and the process of shaping and gluing the trim cap around the edges of the lens is labor intensive. It is, therefore, expensive to manufacture existing lenses which fit across the forward ends of the enclosure of a channel letter.

It would be desirable to provide a channel letter having a lens which could be manufactured without incurring the labor intensive step of requiring the attachment of a trim cap. It would also be desirable to provide a less expensive method of manufacturing and assembling a lens to the enclosure of a channel letter.

SUMMARY OF THE INVENTION

Briefly, the present invention is embodied in a channel letter. For the purposes of this description, a channel letter is defined as including a letter of the alphabet, a numeral, an element of punctuation such as a comma, an exclamation point, or any other shape or form intended to constitute a portion of a sign.

The channel letter of the present invention has a rear surface for mounting against a raceway, a wall, or any other structure suitable for supporting the signage, and walls defining the figuration of the letter or shape to be depicted. A lighting element, such as a strip of LEDs according to the newly available technology or any other light source, is positioned against the rear surface of the enclosure to provide illumination therefore.

In accordance with one embodiment of the invention, to retain the lens to the open front of the enclosure, a shoulder is provided around the inner surface of the sides thereof where the shoulder defines a plane parallel to the outer ends of the sides but is recessed therefrom. A planar transparent lens having an outer edge which is in the shape of the letter and sized to fit within the sides of the enclosure is retained against the shoulder by retaining clamps or by screws extending through the walls of the enclosure with the distal ends thereof projecting in front of the lens.

Where the shoulder supporting the lens is made of rubber or foam, the shoulder may have insufficient rigidity to retain the lens against the elements. Over time, wind, rain, and ice may cause the rubber or foam to yield under the forces applied to the sign by the elements thereby allowing the lens to slide inward or rearward within the walls of the letter. The failure of the foam or rubber will cause the letter to have an unattractive appearance and can result in damage to the lighting fixture within the enclosures or damage to the lens and the wall of the letter. On the other hand, if the fasteners which retain the lens against the shoulder should fail, the lens may fall out of the enclosure altogether.

To prevent the failures described above, the invention may also have a first plurality and a second plurality of retainers spaced around the perimeter of the lens to provide support thereto. Each of the first plurality of retainers has a connector portion for connecting to the wall of the channel letter and a retaining portion which is positioned against the outer surface of the lens to retain it within the walls of the channel letter. Each of the second plurality of retains also has a connector portion and a retaining portion. The connecting portion attaches to the wall of the channel letter and the retaining portion provides support to the rear surface of the lens independent of the shoulder. The plurality of second retainers, therefore, prevents damage to the rubber, foam or other material which forms the shoulder.

In accordance with a second embodiment of the invention the foam or rubber strip around the inner surface of the letter described with respect to the first embodiment is deleted. In this embodiment the lens is again cut into the shape defined by the enclosure with dimensions that are a little less than the inner dimensions of the enclosure. The lens is held in place within the walls of the enclosure by a first plurality and a second plurality of retainers similar to those described with respect to the first embodiment. To provide a seal between the inner surface of the enclosure walls and the edge of the lens, a U-shaped rubber edging is fitted over the outer edge of the lens before the lens is fitted within the walls of the enclosure.

In accordance with a third embodiment of the invention, the lens is cut into the contour defined by the enclosure with the outer dimensions of the lens being a little larger than the outer dimensions of the enclosure such that the edges of the lens overhang beyond the outer edge of the enclosure. A rubber or foam stripping having a constant cross sectional shape is then glued to the inner surface of the enclosure with the forward surface of the rubber or foam projecting a short distance forward of the enclosure to form a seal against the rearward surface of the lens. A plurality of retainers around the perimeter of the lens attach the lens to the walls of the enclosure.

BRIEF DESCRIPTION OF THE DRAWINGS

A better and more complete understanding of the present invention will be had after a reading of the following detailed description taken in conjunction with the drawings wherein.

DETAILED DESCRIPTION OF THE PREFERRED EMBODIMENT

Figure 2:
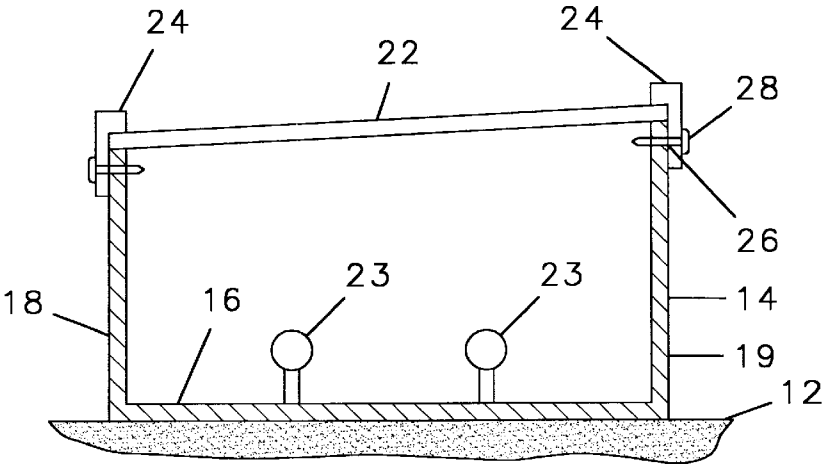
FIG. 2 PRIOR ART
FIG. 2 is an enlarged cross sectional view taken through line 2—2 of FIG. 1.
Figure 1:
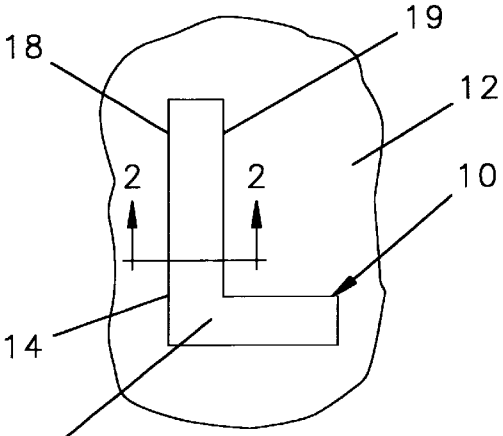
FIG. 1 PRIOR ART
FIG. 1 is a front elevational view of a prior art channel letter.
Figure 3:
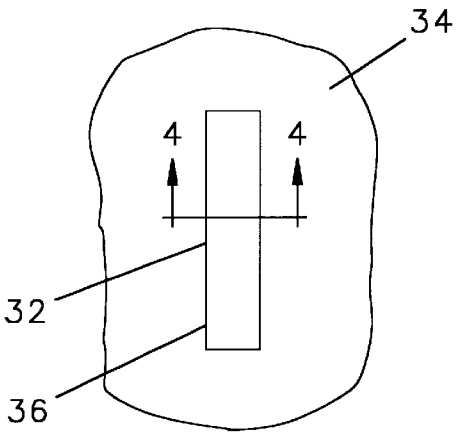
FIG. 3 is a front elevational view of a channel letter in accordance with the present invention.

Referring to FIGS. 1 and 2, a channel letter 10 according to the prior art is mounted on a supporting structure 12. As shown, the channel letter 10 includes a metal enclosure 14 having a rear surface 16 and a plurality of side walls 18, 19 which are contoured to define the edges of a letter 10. The forward edges of the sidewalls 18, 19 define a plane and fitted across the forward edges is a transparent lens 22 having a shape corresponding to that defined by the walls 18, 19 of the enclosure 14. Retained to the rear surface 16 of the enclosure 14 is a light source, which extends through the length of the channel letter 10 and illuminates the entire surface of the lens 22.

Referring further to FIG. 2, in accordance with the prior art, the lens 22 is retained to the side walls 18, 19 of the enclosure 14 by a trim cap 24, a plastic border member which is glued to the outer edges of the lens 22. The trim cap 24 has a rearwardly extending lip 26 that fits over the forward edges of the side walls 18, 19 and the trim cap 24 and the lens 22 are retained to the enclosure member 14 by a plurality of screws 28.

The manufacture of a channel letter 10 in accordance with the prior art requires the construction of the enclosure 14, the manufacture of a light fixture 23 and the lens 22. Manufacture of the lens 22 requires cutting a transparent acrylic material into the shape of the channel letter 10 and attaching the trim cap 24 around the edges thereof. The gluing of the trim cap 24 to the edges of the lens 22, however, must be carefully undertaken and is a time consuming, labor intensive process which adds significantly to the cost of the channel letter 10. The trim cap 24 is intended to meet the sealing standards set by Underwriters Laboratories, but such standards may not be needed for channel letters which employ the new LED technology. It would, therefore, be desirable to provide a less expensive method of attaching a lens 22 to the enclosure of the channel letter 10.

Referring to FIGS. 3, 4, 5, and 6, a channel letter 32 in accordance with a first embodiment of the present invention is attached to a supporting structure 34 and includes a metal enclosure 36 having a rear surface 38 and a plurality of side walls 40, 41 according to the prior art. Fitted within the enclosure 36 is a suitable light source 42. Extending around the inner surface 46, 47 of the side walls 40, 41 and spaced a short distance from the forward edges 48, 49 thereof are shoulders 50, 51 and the forward surfaces 52, 53 of the shoulders define a plane. It should be appreciated that the least expensive method should be employed to provide the shoulders 50, 51 along the inner surfaces 46, 47. Rubber stripping, foam stripping, or any other suitable flexible material can be easily glued to the inner surface of the walls 40, 41 as shown to form the shoulders 50, 51.

Figure 4:
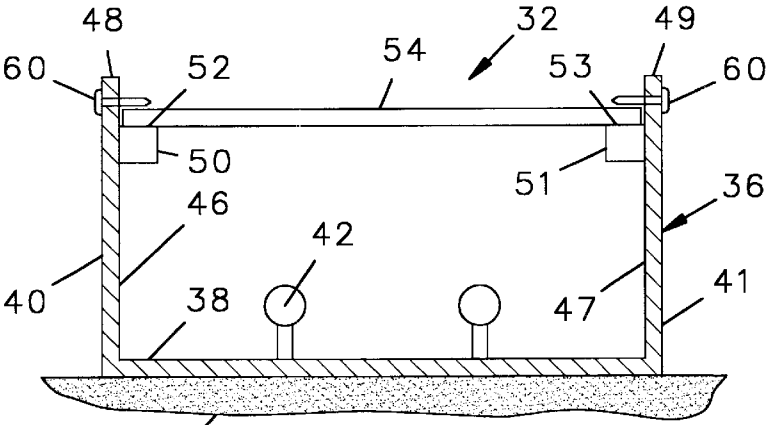
FIG. 4 is an enlarged cross sectional view of the channel letter in FIG. 3 taken through line 4—4 thereof.
Figure 6:
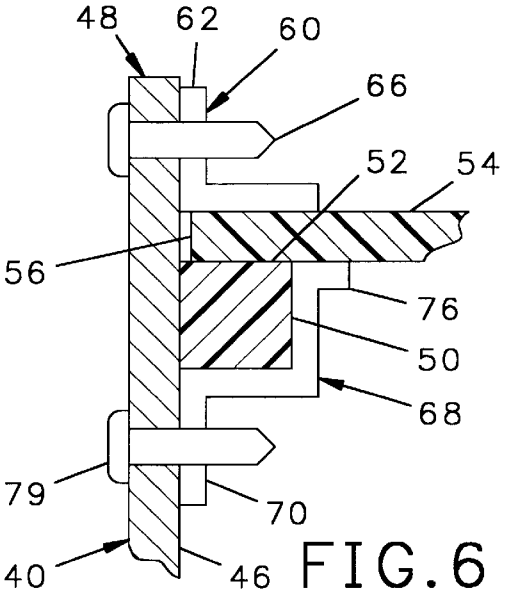
FIG. 6 is a fragmentary enlarged cross sectional view of the mounting of the lens in the enclosure of the channel letter shown in FIG. 3.

The lens 54 for the channel letter 32 is cut from a planar panel of transparent acrylic with the outer edges 56 thereof having dimensions small enough to fit within the walls 40, 41 of the letter 32 and against the forward surfaces 52, 53 of the shoulders 50, 51. Extending around the perimeter of the lens 54 is a first plurality of retainers for retaining the lens 54 against the shoulder 50, 51. As shown in FIG. 4. the retainers may be simple screws 59 extending through the walls of the enclosure with the distal ends of the screws 59 forming a barrier for retaining the lens 54. As shown in FIG. 6, as an alternative to the screws 59, retainers 60 formed from aluminum, of any other suitable material, having a mounting portion 62 for attachment to the inner surface of the wall 40 by a screw 64 extending through the wall 40, may be used. The retainers 60 have a planar retaining portion 66 which forms a 90° angle with the mounting portion 62, ans has a rear surface which abuts the forward surface of the lens 54 to retain the lens 54 within the walls of the enclosure and against the shoulders 50, 51.

In addition to the first plurality of retainers 59, 60, a plurality of second retainers 68 also extend around the perimeter of the lens 54 to provide support of the inner surface of the lens 54. As shown, each of the second retainers 68 has a mounting portion 70 which is attached by a screw 79 extending through a portion of the wall 40 and into the mounting portion 70. A formed arm 74 extends from the mounting portion 70, around the rubber of foam body of the shoulder 50, and to a retaining portion 76. The retaining portion has a surface which contacts the rear surface of the lens 54 when the lens 54 is pressed against the shoulder 50. The second retainers 68 provide support to the lens 54 and thereby prevent damage to the foam or rubber which make up the shoulders 50, 51.

Figure 7:
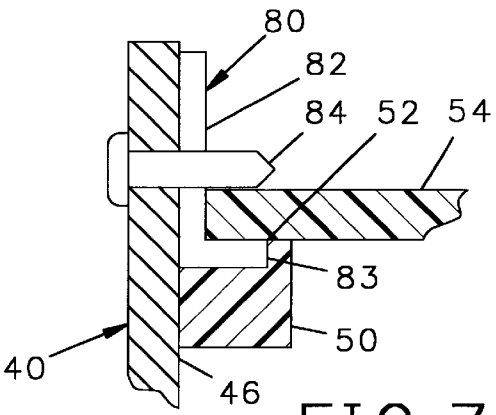
FIG. 7 is a fragmentary enlarged cross sectional view of an alternate mounting of the lens to an enclosure of a channel letter.
Figure 5:
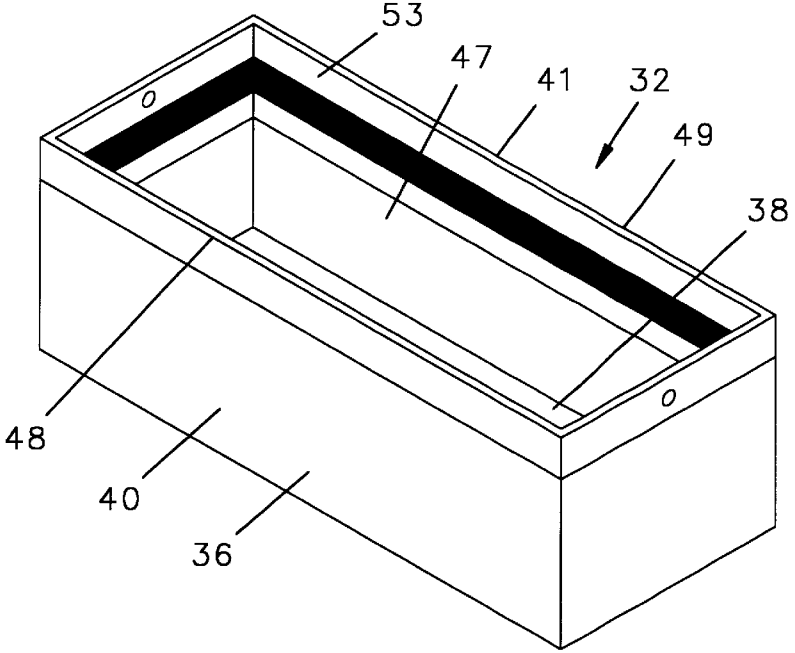
FIG. 5 is a fragmentary isometric view of a portion of the enclosure of the channel letter in FIG. 3.

FIG. 7 depicts a second configuration for a plurality of retainers to retain the lens 54 to the enclosure 36. In this configuration a retainer 80 has an elongate mounting portion 82 which is retained along the inner surface 46 of the wall 40 by a screw 84 extending through the wall 40. Positioned perpendicular to the mounting portion 82 is a retaining portion 83 having a forward surface against which the lens 54 is positioned. In this configuration the retaining portion 83 is positioned against the foam or rubber shoulder 50, deforming and compressing the forward surface 52 thereof. The foam or rubber is deformed only in the immediate proximity of the retainers 80, and except for the portion of the shoulder 50 deformed by the 80, the foam or rubber will seal against the inner surface of the lens 54. In the embodiment depicted, the retaining portion 83 is positioned at the rearward end of the mounting portion 82 and the retaining screw 84 are paced from the retaining portion distance such that the distal end of the screw 84 will retain the lens 54 against the retaining portion 83.

Figure 9:
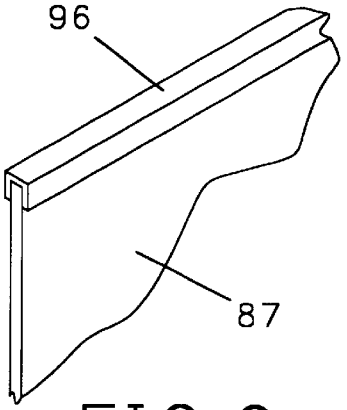
FIG. 9 is a fragmentary isometric view of an insulating edging attached around a portion of the lens.
Figure 10:
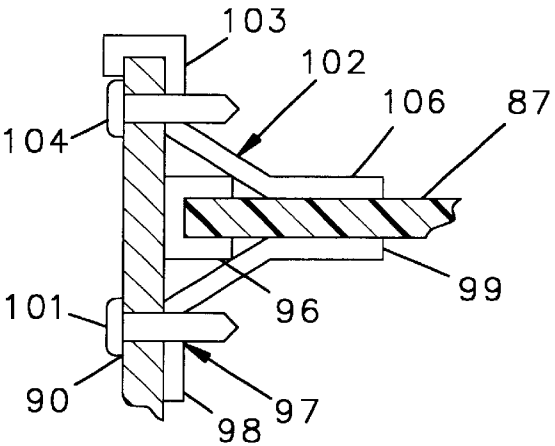
FIG. 10 is a fragmentary enlarged cross sectional view of both a first and a second retainers used with the second embodiment depicted in FIG. 8.
Figure 8:
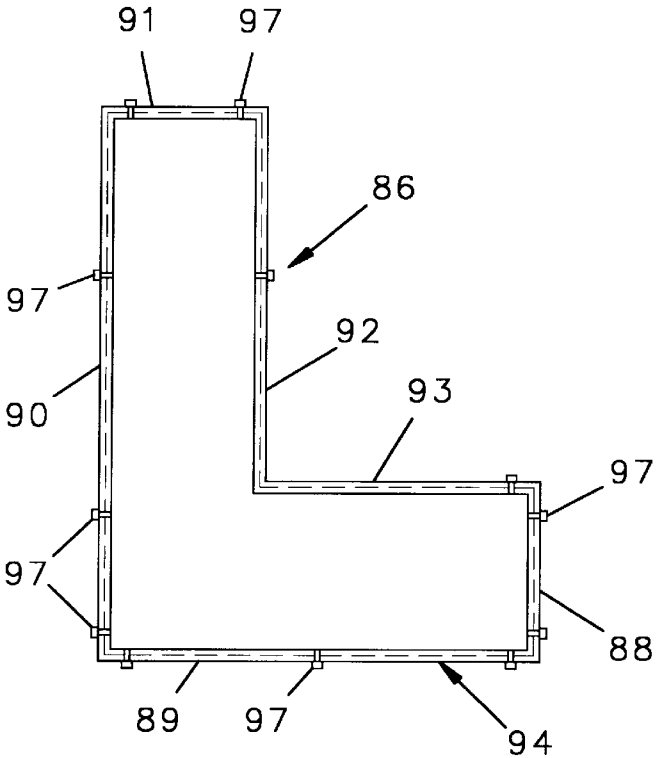
FIG. 8 is a front elevational view of a channel letter constructed in accordance with a second embodiment of the invention.

Referring to FIGS. 8 to 10, in a second embodiment of the invention, a lens 87 of a channel letter 86 is retained within the walls 88–93 of an enclosure 94 by a first and a second plurality of spaced retainers without employing the shoulders 50, 51 of the first embodiment. In this embodiment a U-shaped rubberized edging 96 is fitted around the outer edge of the lens 87 so that the back of the edging 96 will abut the inner surfaces of the walls 88–93 to seal the lens 87 against the walls 88–93. The first plurality of retainers 97 are spaced around the perimeter of the channel letter and have mounting positions 98 which extend, along the inner surface of the walls 88–93 and retaining portions 99 oriented perpendicular to the mounting position 98. The retainers 97 are positioned on the walls 88–93 such that the retaining portions 99 thereof define a plane recessed a short distance from the ends 100 of the walls 88–93. The rearward surface of the lens 87 is positioned across the retainer portions 99 of the retainers 96 and are held in place by an associated screws 101.

A second plurality of angular shaped retainers 102 retain the lens 87 within the forward end of the enclosure 94. Each of the second plurality of retainers 102 has a mounting portion 103 secured to the inner surface of the wall 88–93 by a screw 104 and a perpendicularly extending retaining portion 106 abutting the forward surface of the lens 87.

Figure 13:
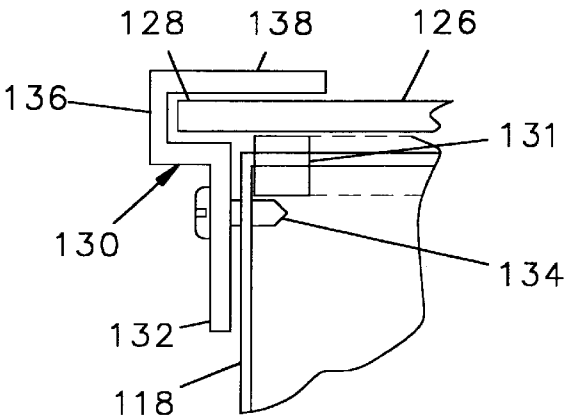
FIG. 13 is a fragmentary enlarged cross sectional view of a retainer used to retain the lens in accordance with the third embodiment depicted in FIG. 11.
Figure 11:
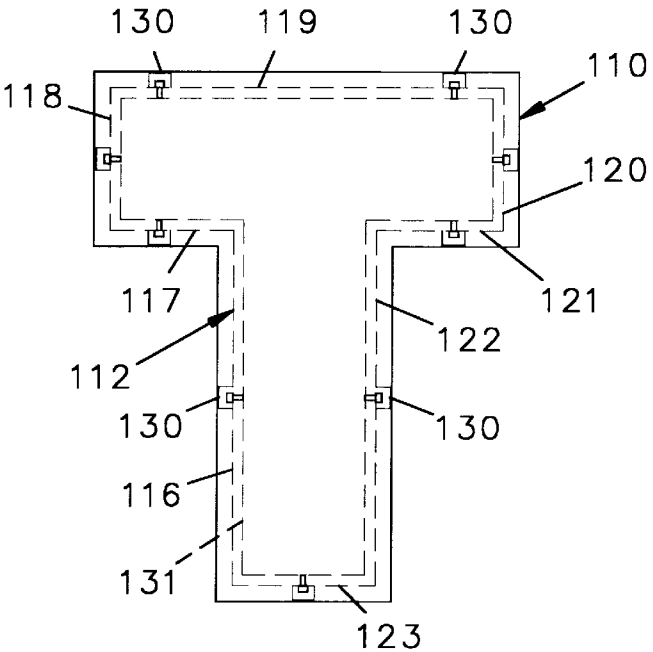
FIG. 11 is a front elevational view of a channel letter constructed in accordance with a third embodiment of the invention.
Figure 12:
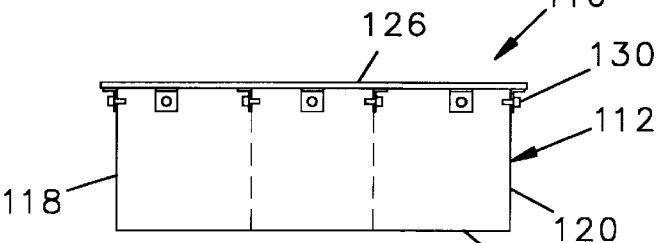
FIG. 12 is a cross sectional view of the channel letter shown in FIG. 11.

Referring to FIGS. 11 to 13, in a third embodiment of the invention a channel letter 110 includes an enclosure 112 having a back 114 and a plurality of walls 116 to 123 which define the shape of the letter 110. Across the forward ends of the walls 116–123 of the enclosure 112 is an acrylic lens 126 having an outer edge 128 in the shape of the letter 110 but having outer dimensions that are a little larger than the outer dimensions defined by the walls 116–123. The outer edge 128 of the lens overhangs beyond the walls 116–123, and is retained in place by a plurality of retainers 130 spaced around the walls 116–123 of the enclosure 112. A strip 131 of foam or rubber is glued around the inner surface of the enclosure 112 with the forward surface of the strip 131 extending forward of the forward ends of the walls 116–123 a short distance, perhaps ⅛ th inch to form a seal between the enclosure and the lens 126.

Referring to FIG. 13, in the preferred configuration, each retainer 130 has a planer attachment portion 132 for receiving a sheet metal screw 134 for attachment to one of the walls, of which wall 118 is representative of all the walls 116–123. A hooked shaped retaining portion 136 extends around the outer edge 128 of the lens 126. A cap 138 similar to the rubberized edging 96 described with respect to the second embodiment may be fitted around the outer edge 128 of the lens 126 prior to assembling the retainers 130 to block light rays from radiating out the ends of the lens 126.

Figure 14:
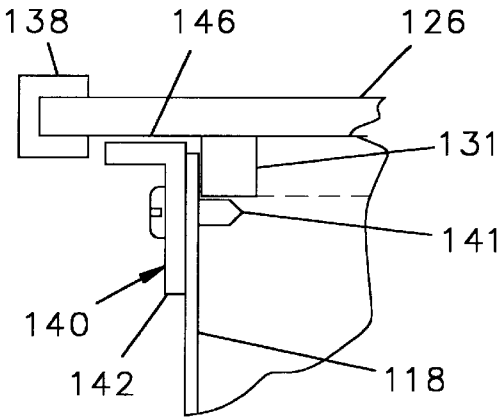
FIG. 14 is a fragmentary enlarged cross sectional view of an alternate retainer used to retain the lens in accordance with the third embodiment depicted in FIG. 11.

Referring to FIG. 14, in which an alternate embodiment of a retainer 140 is depicted, the retainer 140 has a planar mounting portion 142 for receiving a screw 144 for attachment to the wall 118 of the enclosure, and a perpendicularly extending attachment portion 146 having a planar surface which is glued to the rearward surface of the lens 126.

The lens of all the embodiments of the present invention can be manufactured and attached to their associated enclosures less expensively than can the presently available lenses. Once assembled, the lenses of the present invention can be adequately sealed against the walls of the enclosure to protect the light source, and will present an attractive appearance.

While several embodiments of the present invention have been disclosed, it will be appreciated that many modifications or variations may be made without departing from the true spirit and scope of the invention. It is, therefore, the intent of the pending claims to cover all such variations and modifications which fall within the true spirit and scope of the invention.

What is claimed:

1. A channel letter comprising an enclosure having walls defining the figuration of said letter and having an open front, said walls having an inner surface and a forward end, a shoulder on at least one of said inner surface of said walls, said shoulder on said inner surfaces defining a plane, said shoulder formed solely by a strip of flexible material having a continuous cross section secured to said inner surface, said shoulder spaced from said forward ends of said walls, a planar at least partially transparent lens having a forward surface, a rearward surface, and an outer edge in said figuration of said letter and sized to fit within said walls of said enclosure and against at least a portion of said shoulder, a first retainer means in contact against said forward surface for retaining said lens within said enclosure and against said shoulder, a second retainer means in contact against said rearward surface for retaining said lens from damaging said shoulder, and a light source within said enclosure.

2. A channel letter in accordance with claim 1 and further comprising a rear surface, and said inner surface of said walls extending without interruption from said rear surface to said forward end.

3. A channel letter comprising an enclosure having walls defining the figuration of said letter and having an open front, said walls having an inner surface and a forward end, a shoulder on at least one of said inner surface of said walls, said shoulder on said inner surfaces defining a plane, said shoulder formed solely by a strip of flexible material having a continuous cross section secured to said inner surface, said shoulder spaced from said forward ends of said walls, a planar transparent lens having a forward surface, a rearward surface, and an outer edge in said figuration of said letter and sized to fit within said walls of said enclosure and against at least a portion of said shoulder, a first retainer means against said forward surface for retaining said lens within said enclosure and against said shoulder, said first retainer means comprising a plurality of retainer members, each of said retainer members having a mounting portion for attachment to said walls and a retaining portion for contacting said forward surface of said lens, a second retainer means against said rearward surface for retaining said lens from damaging said shoulder, and a light source within said enclosure.

4. A channel letter comprising an enclosure having walls defining the figuration of said letter and having an open front, said walls having an inner surface and a forward end, a shoulder on at least one of said inner surface of said walls, said shoulder on said inner surfaces defining a plane, said shoulder formed solely by a strip of flexible material having a continuous cross section secured to said inner surface, said shoulder spaced from said forward ends of said walls, a planar transparent lens having a forward surface, a rearward surface, and an outer edge in said figuration of said letter and sized to fit within said walls of said enclosure and against at least a portion of said shoulder, a first retainer means against said forward surface for retaining said lens within said enclosure and against said shoulder, a second retainer means against said rearward surface for retaining said lens from damaging said shoulder, said second retainer means comprising a plurality of retainer members, each of said retainer members having a mounting portion for attachment to said walls and a retaining portion for contacting said rearward surface of said lens, and a light source within said enclosure.

* * * * *